US009089206B2

(12) United States Patent
Baylor et al.

(10) Patent No.: US 9,089,206 B2
(45) **Date of Patent: *Jul. 28, 2015**

(54) PORTABLE PODIUM

(75) Inventors: Timothy A. Baylor, Niles, MI (US); Joel S. Barrett, Mishawaka, IN (US); Larry Barrett, Niles, MI (US)

(73) Assignee: BERRIEN METAL PRODUCTS, INC., Buchanan, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/196,271

(22) Filed: Aug. 2, 2011

(65) Prior Publication Data

US 2012/0223209 A1 Sep. 6, 2012

Related U.S. Application Data

(63) Continuation-in-part of application No. 13/039,613, filed on Mar. 3, 2011.

(51) Int. Cl.

| | |
|---|---|
| ***A47B 19/08*** | (2006.01) |
| ***A47B 3/10*** | (2006.01) |
| ***A47B 19/00*** | (2006.01) |
| ***A47B 3/08*** | (2006.01) |
| ***A47B 61/00*** | (2006.01) |
| ***A47B 43/00*** | (2006.01) |

(52) U.S. Cl.

CPC . *A47B 19/08* (2013.01); *A47B 3/08* (2013.01); *A47B 3/10* (2013.01); *A47B 19/00* (2013.01); *A47B 43/00* (2013.01); *A47B 61/00* (2013.01)

(58) Field of Classification Search

CPC ..... A47B 19/08; A47B 3/10; A47B 19/00; A47B 3/08; A47B 2003/0824; A47B 61/00; A47B 43/00

USPC ..... 248/174, 460, 465, 447, 459, 461, 462, 248/463, 464; 312/140.2, 258, 262

See application file for complete search history.

(56) References Cited

U.S. PATENT DOCUMENTS

| | | | | | |
|---|---|---|---|---|---|
| 242,355 | A | * | 5/1881 | Nicholas | 217/16 |
| 1,015,430 | A | * | 1/1912 | Farmer | 217/15 |
| 1,342,269 | A | * | 6/1920 | Stewart | 312/258 |
| 2,031,477 | A | * | 2/1936 | Gianninoto et al. | 248/459 |
| 2,188,602 | A | * | 1/1940 | Hall | 248/459 |
| 2,309,876 | A | * | 2/1943 | Todd | 248/460 |
| 2,507,620 | A | * | 5/1950 | Val Barbara | 248/459 |
| 2,583,931 | A | * | 1/1952 | Cummings | 312/262 |
| 2,597,970 | A | * | 5/1952 | Bollettieri | 312/233 |

(Continued)

FOREIGN PATENT DOCUMENTS

| | | | |
|---|---|---|---|
| KR | 2020090009338 | * | 9/2009 |
| WO | WO 2008047230 A1 | * | 4/2008 |

OTHER PUBLICATIONS

PCT International Search Report and Written Opinion, PCT/US2011/026962, date completed Apr. 8, 2011; date mailed Apr. 19, 2011.

(Continued)

*Primary Examiner* — Terrell McKinnon
*Assistant Examiner* — Eret McNichols
(74) *Attorney, Agent, or Firm* — Miller Canfield Paddock and Stone; John H Engelmann

(57) ABSTRACT

This invention provides to a full size convenient folding portable podium which folds together as a single unit and thus requires no assembly or disassembly.

6 Claims, 11 Drawing Sheets

(56) References Cited

U.S. PATENT DOCUMENTS

| | | | | | |
|---|---|---|---|---|---|
| D171,858 | S | * | 3/1954 | Mont | D26/15 |
| 2,808,305 | A | * | 10/1957 | Jackson | 312/140.2 |
| 3,313,249 | A | * | 4/1967 | Marcy | 108/124 |
| D210,670 | S | | 4/1968 | Eddy | |
| 3,848,944 | A | * | 11/1974 | Gilmer, Jr. | 312/314 |
| 4,059,058 | A | * | 11/1977 | Kazuhide | 108/129 |
| 4,166,926 | A | * | 9/1979 | Sieler | 381/75 |
| 4,484,787 | A | | 11/1984 | Stephens | |
| 4,579,401 | A | * | 4/1986 | Mears | 312/258 |
| 4,711,046 | A | * | 12/1987 | Herrgord | 40/605 |
| D320,319 | S | | 10/1991 | Brothers et al. | |
| 5,114,111 | A | * | 5/1992 | Andrews | 248/460 |
| 5,152,491 | A | * | 10/1992 | Forster et al. | 248/454 |
| 5,315,935 | A | * | 5/1994 | Weisenfels | 108/193 |
| 5,355,555 | A | * | 10/1994 | Zarelius | 16/225 |
| 5,382,087 | A | * | 1/1995 | Pouch | 312/140.2 |
| 5,480,119 | A | | 1/1996 | Fish et al. | |
| 5,882,098 | A | * | 3/1999 | Brown et al. | 312/258 |
| 6,039,418 | A | * | 3/2000 | Thomas | 312/258 |
| 6,039,419 | A | * | 3/2000 | Brown et al. | 312/262 |
| 6,092,885 | A | | 7/2000 | James | |
| 6,325,343 | B1 | * | 12/2001 | Flagg | 248/174 |
| 6,513,443 | B2 | * | 2/2003 | Todd | 108/115 |
| 6,948,787 | B2 | * | 9/2005 | McBrayer et al. | 312/258 |
| 7,213,895 | B2 | * | 5/2007 | Wu | 312/258 |
| 7,304,839 | B1 | * | 12/2007 | Burns | 361/679.55 |
| 7,636,985 | B2 | * | 12/2009 | Greenbank | 16/389 |
| 8,029,077 | B2 | * | 10/2011 | Cheng et al. | 312/262 |
| 8,113,605 | B2 | * | 2/2012 | Ceballos-Godefroy | 312/262 |
| 2008/0149006 | A1 | * | 6/2008 | Leng | 108/121 |
| 2009/0284963 | A1 | | 11/2009 | Intravatola | |
| 2010/0006735 | A1 | | 1/2010 | Reinen | |
| 2010/0282180 | A1 | * | 11/2010 | Moffett-Chaney et al. | 119/484 |

OTHER PUBLICATIONS

DICTIONARY.COM—a hook and eye—http://dictionary.reference.com/browse/hook_and_eye.

* cited by examiner

PORTABLE PODIUM

CROSS REFERENCE TO RELATED APPLICATIONS

This application asserts priority from provisional application 61/310,735, filed on Mar. 5, 2010 which is incorporated herein by reference.

FIELD OF INVENTION

This invention relates to a convenient folding portable podium which folds together so that the podium, when folded together serves as its own flat rectangular case. The podium is simply unfolded for use. Since the podium folds as a single unit it requires no assembly or disassembly.

BACKGROUND OF THE INVENTION

U.S. Pat. No. 4,484,787 relates to a combination voting booth/speaker's lectern which is assembled from several pieces. When disassembled the pieces of the podium would require a separate case. U.S. Pat. No. 5,480,119 relates to a portable desk top podium having a removable shelf and a front and sides, which fold together. U.S. Pat. No. 6,092,885 relates to a portable podium, which may be disassembled into several pieces. US Patent publication 2009/0284963 relates to a collapsible portable stand in which has support legs and a mast that collapse into a small equipment enclosure or case. US Patent publication 20100006735 relates to a multipurpose platform suitable for use as a desk and an easel. U.S. design Pat. D320319 relates to a portable lectern. U.S. design Pat. US D210670 relates to a portable lectern and a carrying case.

BRIEF SUMMARY OF THE INVENTION

This invention provides a full size convenient folding portable podium which folds together as a single unit and thus requires no assembly or disassembly. The podium provides a front panel, side panels, a shelf, a bottom panel, and a top surface which may be slanted. The components of the podium are connected together with hinges so that they may be folded together without disassembly. The podium, when folded together serves as its own flat rectangular case.

BRIEF DESCRIPTION OF THE DRAWINGS

FIG. 11 B shows a view of a desk or table top embodiment of the invention on its front face.

FIG. 11 C shows a view of a desk or table top embodiment of the invention on its front face.

DETAILED DESCRIPTION OF THE INVENTION

Figure 1:
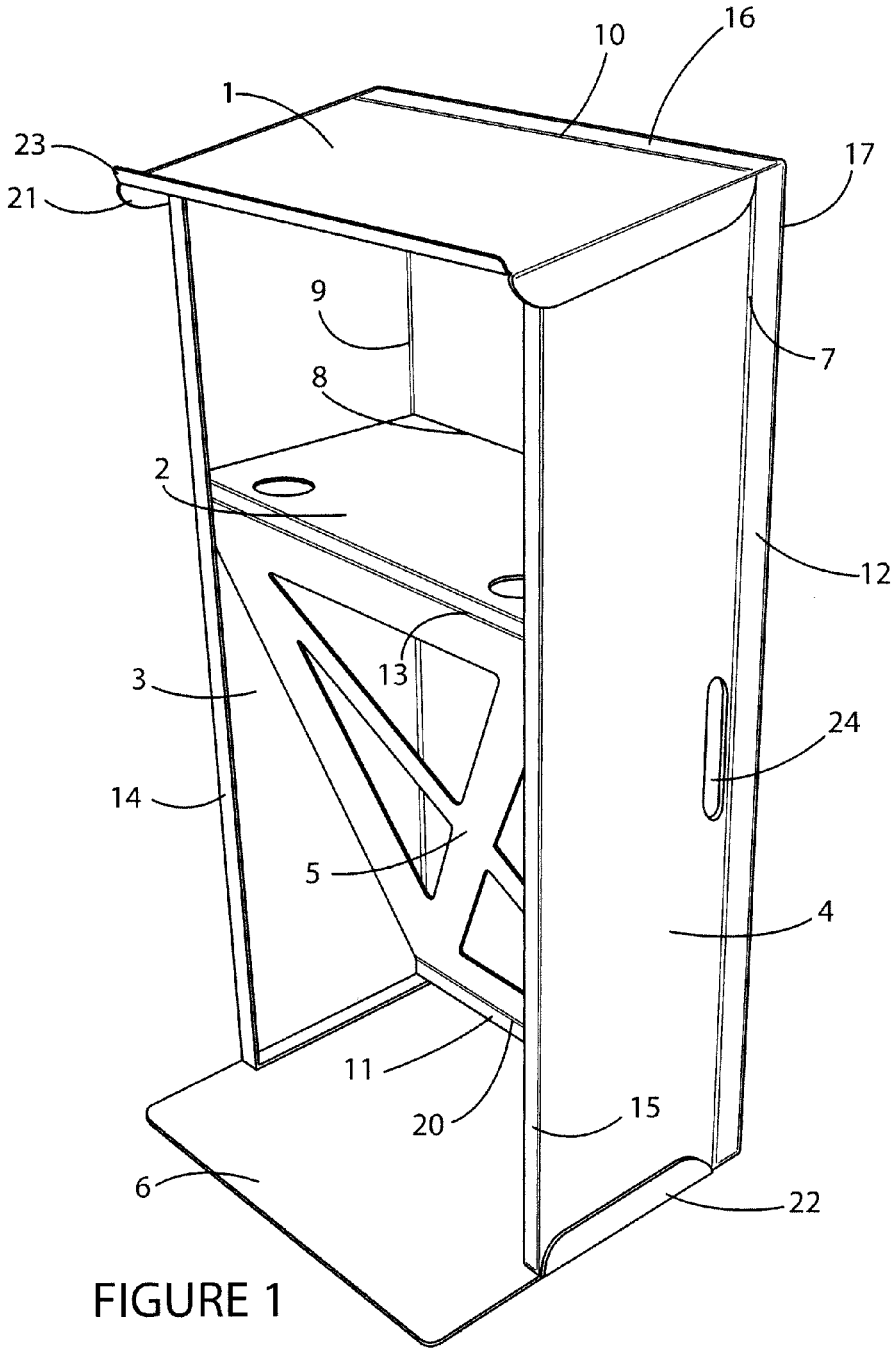
FIG. 1 shows a view of the unfolded podium from the side and behind the podium.

FIG. 1 shows a view of the unfolded podium from the side and behind the podium. At the top of the podium is a desk top 1 on which the speaker may place papers, display control devices, and the like. At the bottom of the podium is a base panel 6. In the middle of the podium is a middle shelf 2. A lip 29 on the middle shelf is shown (front side closest to the speaker). The front panel 17 of the podium has side lips 12, a base lip 20, and a top lip 16. The desk top 1 attaches to the top lip 16 of the front panel 17 of the podium with a hinge 10. The base panel 6 attaches to the base lip 20 of the front panel 17 of the podium with a hinge 11. The middle shelf attaches to the inside of the front panel 17 with a hinge 8. The left side panel of the podium (from the speaker's point of view) 3 is shown. The left side panel has a lip 14. The right side panel of the podium (from the speaker's point of view) 4 is shown. The right side panel has a lip 15. The side panels 3 and 4 are attached to the front panel 17 by hinges 9 and 7. When folded down for use, the middle shelf 2 is retained in a horizontal position by contact of the lip 29 of middle shelf 2 with the lips 14 and 15 of the podium side panels 3 and 4. An optional support 5 is shown. The optional support is attached to the lip 29 on the middle shelf 2 with a hinge 13. Side lip 21 of the desk top 1 and side lip 22 of the base panel 6 are shown. An optional front lip (side closest to the speaker) 23 on the desk top 1 is shown. An optional slot 24 on the side panel 4 is shown. These slots can serve as handles when the podium is folded.

Figure 2:
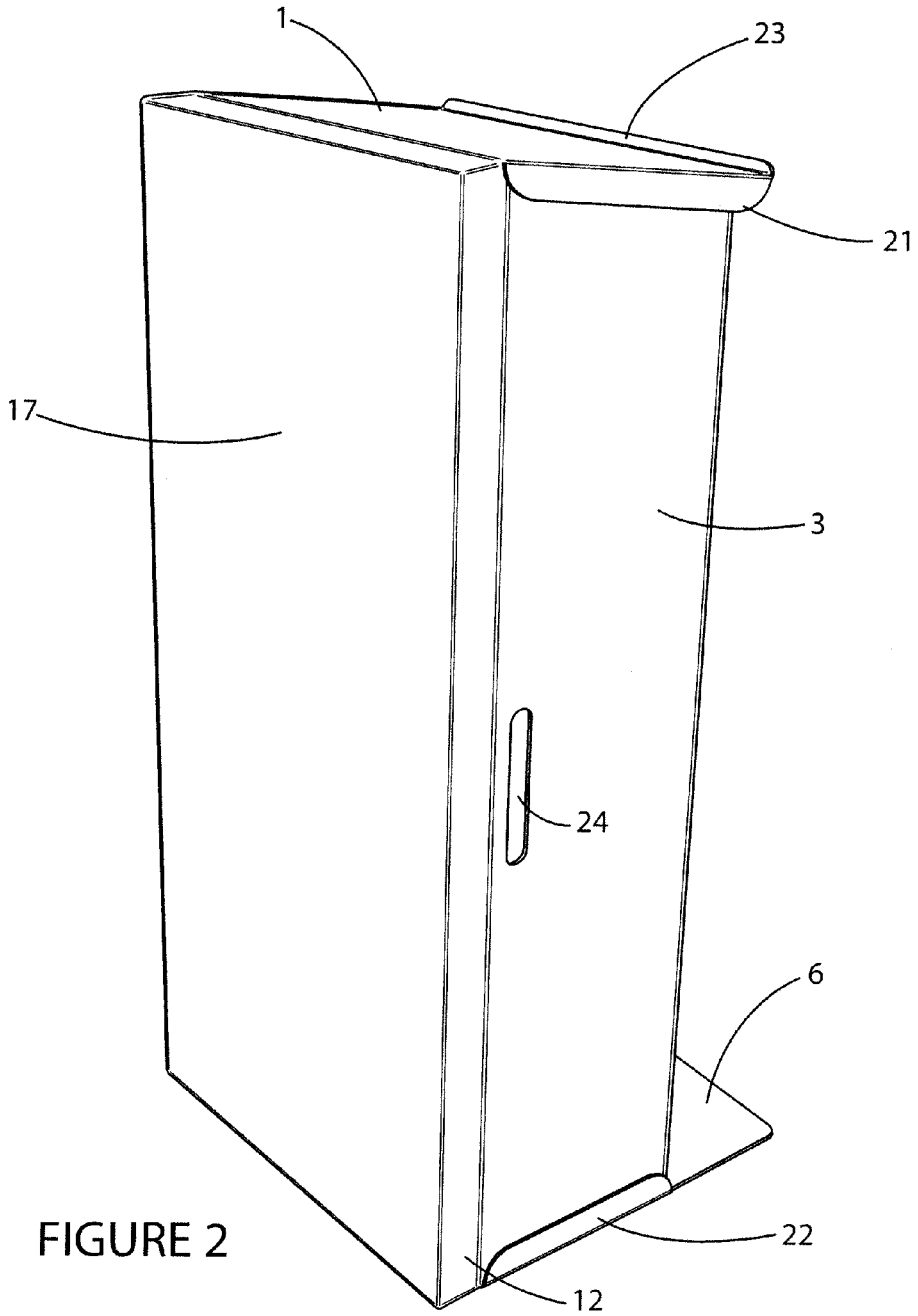
FIG. 2 shows a view of the unfolded podium from the side and the front the podium.

FIG. 2 shows a view of the unfolded podium from the side and the front the podium. The desk top 1, front panel 17, base panel 6, left side panel 3, side lip 12 of the front panel 17, side lip 21 of the desk top 1, side lip 22 of the base panel 6, front lip 23 on the desk top 1, and slot 24 on the side panel 3 is shown.

Figure 3:
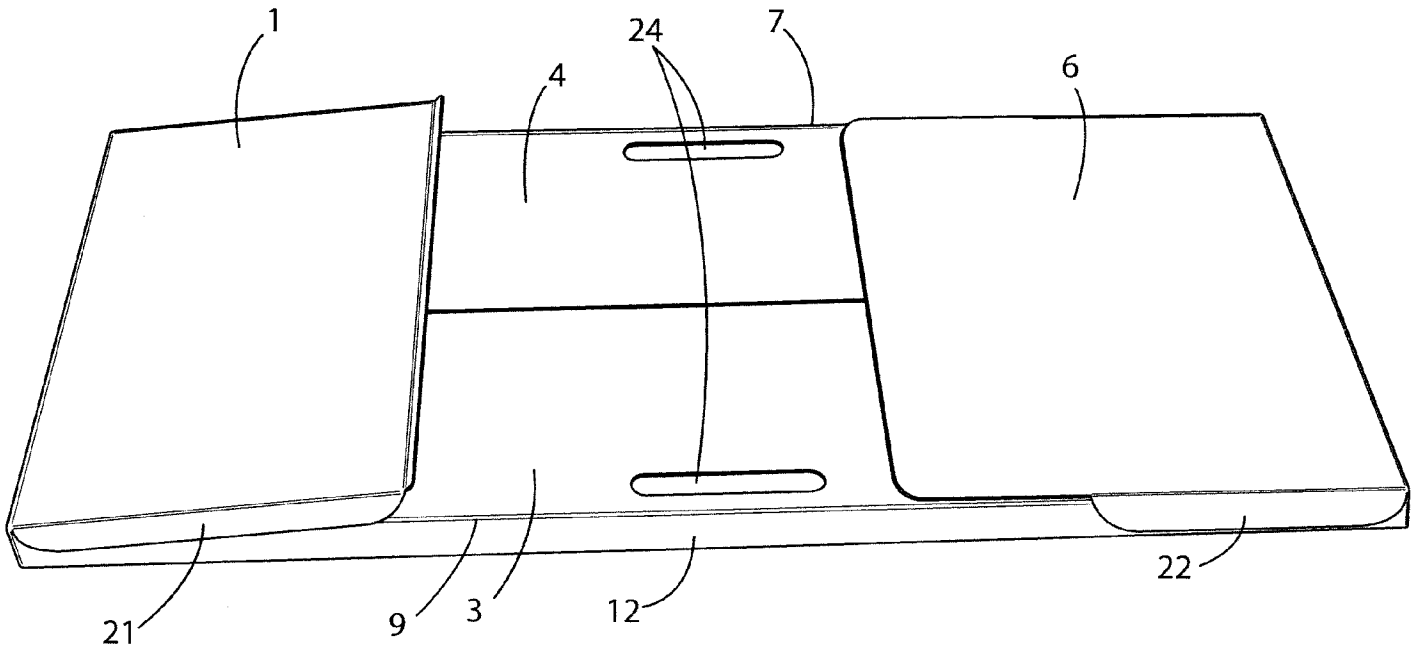
FIG. 3 shows a view of the folded podium with the front panel down.

FIG. 3 shows a view of the folded podium with the front panel 17 down and not shown. The desk top 1, base panel 6, side panels 3 and 4, hinges 9 and 7, side lip 12 of the front panel 17, side lip 21 of the desk top 1, side lip 22 of the base panel 6, and slots 24 on the side panels 3 and 4 are shown.

Figure 4:
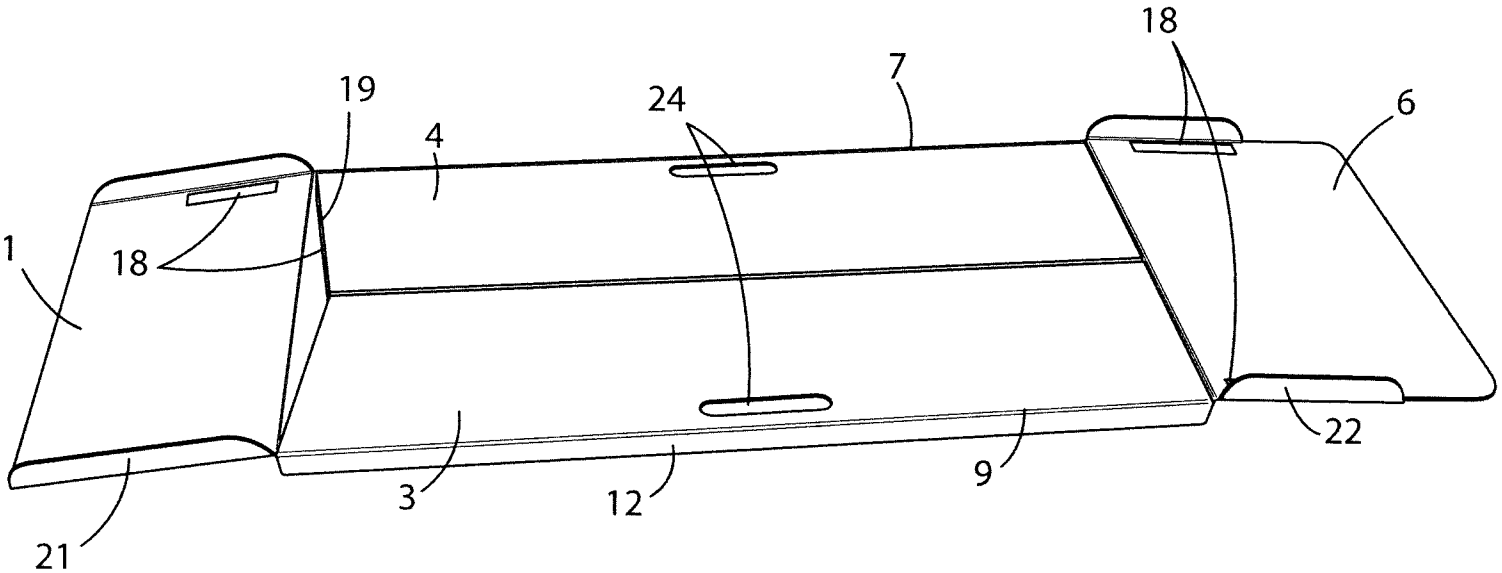
FIG. 4 shows a view of the first step in unfolding the podium.

FIG. 4 shows a view of the first step in unfolding the podium. The front panel 17 is down and not shown. The desk top 1, base panel 6, side panels 3 and 4, hinges 9 and 7, side lip 12 of the front panel 17, side lip 21 of the desk top 1, side lip 22 of the base panel 6, and slots 24 on the side panels 3 and 4 are shown. Fastening means 18 such as Velcro® hook and loop fasteners are shown. Optionally the tops 19 of the side panels 3 and 4 may be slanted allowing the desk top 1 to be slanted downward rather than being horizontal.

Figure 5:
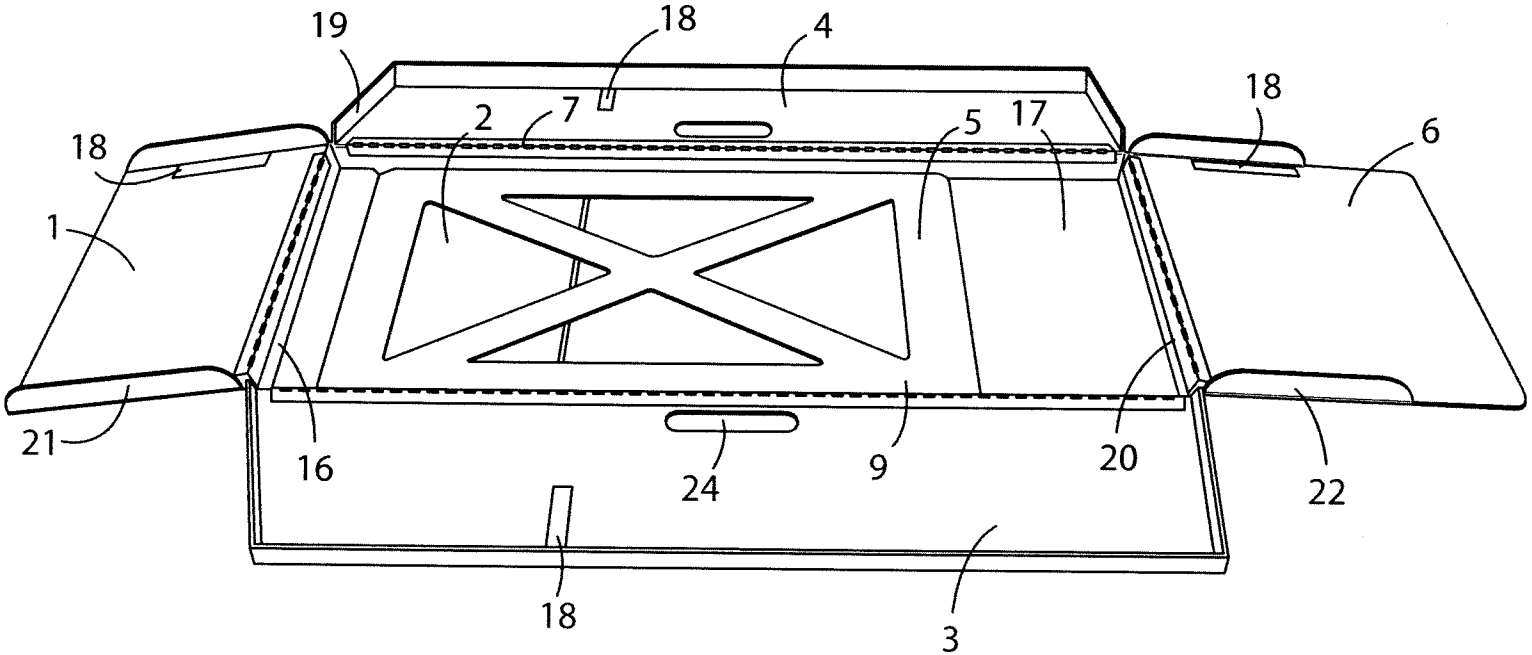
FIG. 5 shows a view of the second step in unfolding the podium.

FIG. 5 shows a view of the second step in unfolding the podium. The front panel 17 is down and the front surface is not shown. The desk top 1, base panel 6, side panels 3 and 4, hinges 9 and 7, a fastening means 18, slanted tops 19 of the side panels 3 and 4, middle shelf 2, support 5, top lip 16 of front panel 17, bottom lip 20 of front panel 17, side lip 21 of the desk top 1, and side lip 22 of the base panel 6 are shown.

Figure 6:
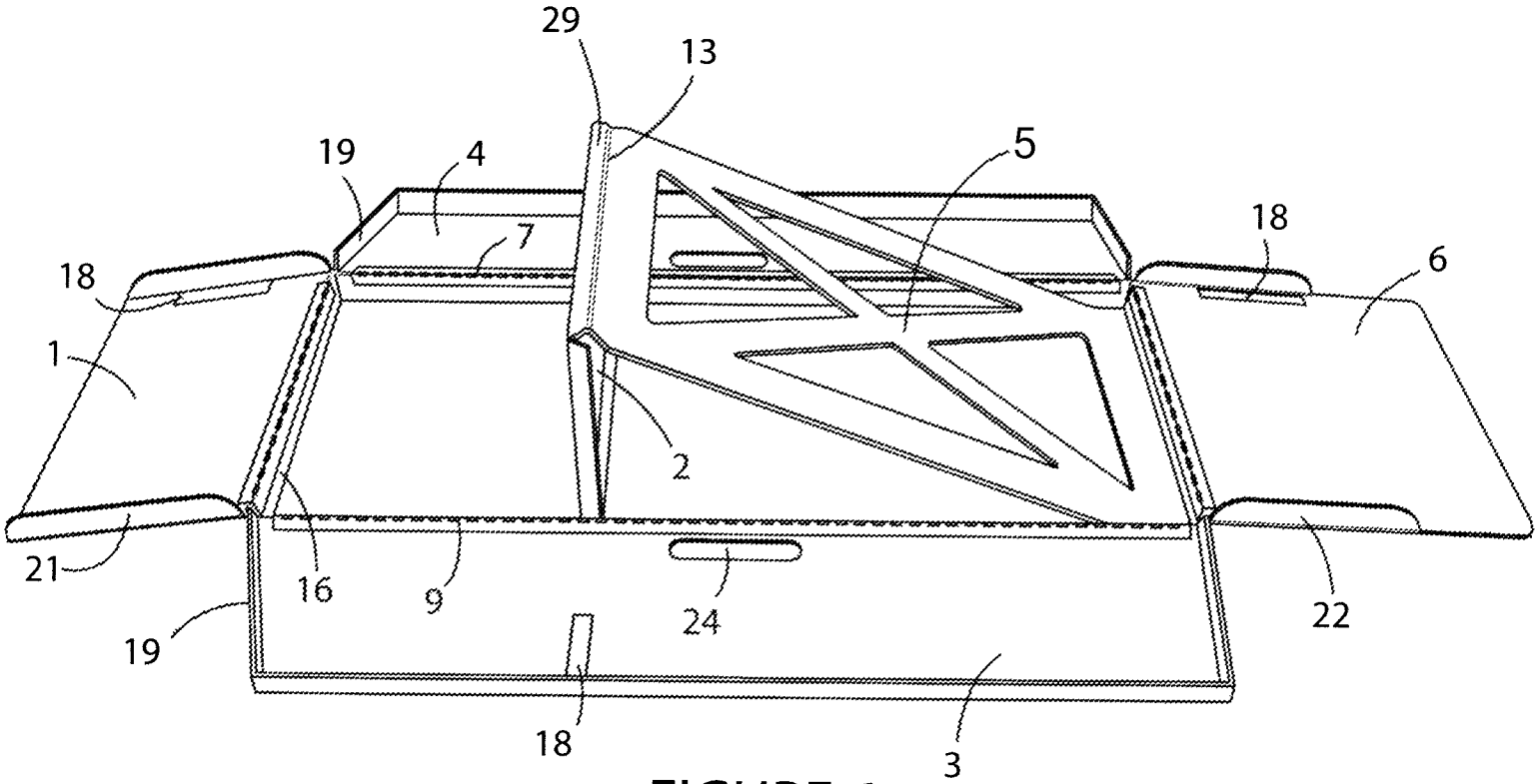
FIG. 6 shows a view of the third step in unfolding the podium.

FIG. 6 shows a view of the third step in unfolding the podium. The front panel 17 is down and the front surface is not shown. The desk top 1, base panel 6, side panels 3 and 4, hinges 9 and 7, a fastening means 18, slanted tops 19 of the side panels 3 and 4, front lip 29 of middle shelf 2, support 5, hinge 13, side lip 21 of the desk top 1, and side lip 22 of the base panel 6 are shown.

Figure 7:
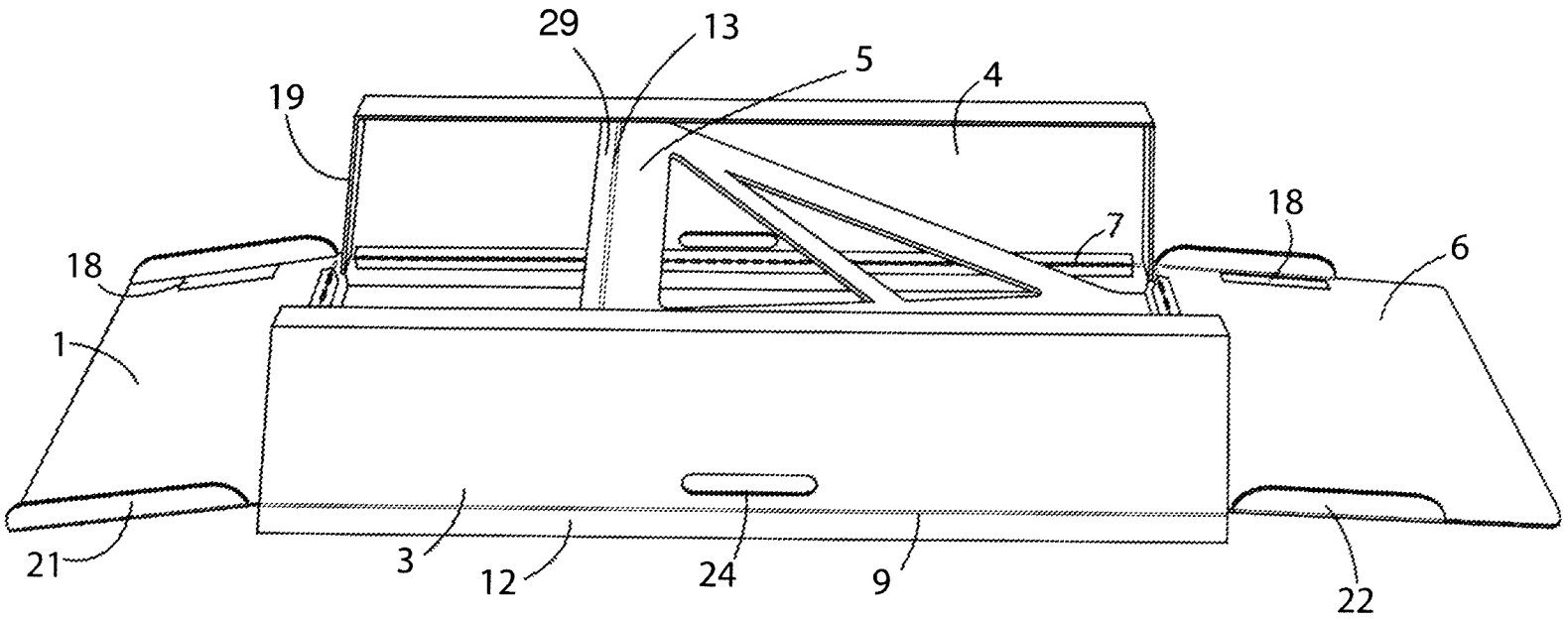
FIG. 7 shows a view of the fourth step in unfolding the podium.

FIG. 7 shows a view of the fourth step in unfolding the podium. The front panel 17 is down and the front surface is not shown. The desk top 1, base panel 6, side panels 3 and 4, hinges 9 and 7, a fastening means 18, slanted tops 19 of the side panels 3 and 4, front lip 29 of middle shelf 2, support 5, hinge 13, side lip 12 of the front panel 17, side lip 21 of the desk top 1, and side lip 22 of the base panel 6 are shown.

Figure 8:
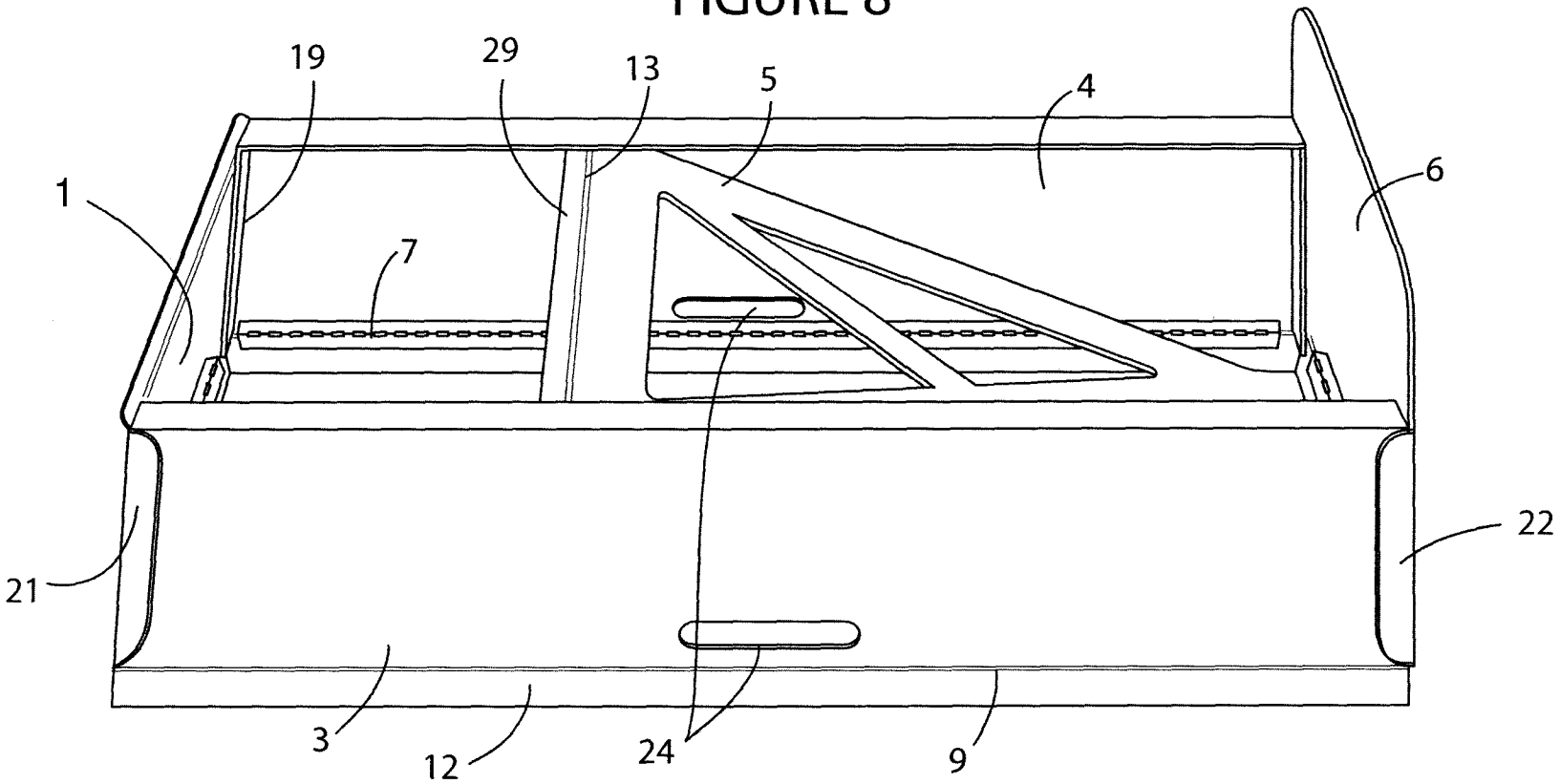
FIG. 8 shows a view of the last step in unfolding the podium.

FIG. 8 shows a view of the last step in unfolding the podium. The front panel 17 is down and the front surface is not shown. The desk top 1, base panel 6, side panels 3 and 4, hinges 9 and 7, slanted tops 19 of the side panels 3 and 4, front lip 29 of middle shelf 2, support 5, hinge 13, side lip 12 of the front panel 17, side lip 21 of the desk top 1, side lip 22 of the base panel 6, slots 24 on the side panels 3 and 4 are shown.

Figure 9:
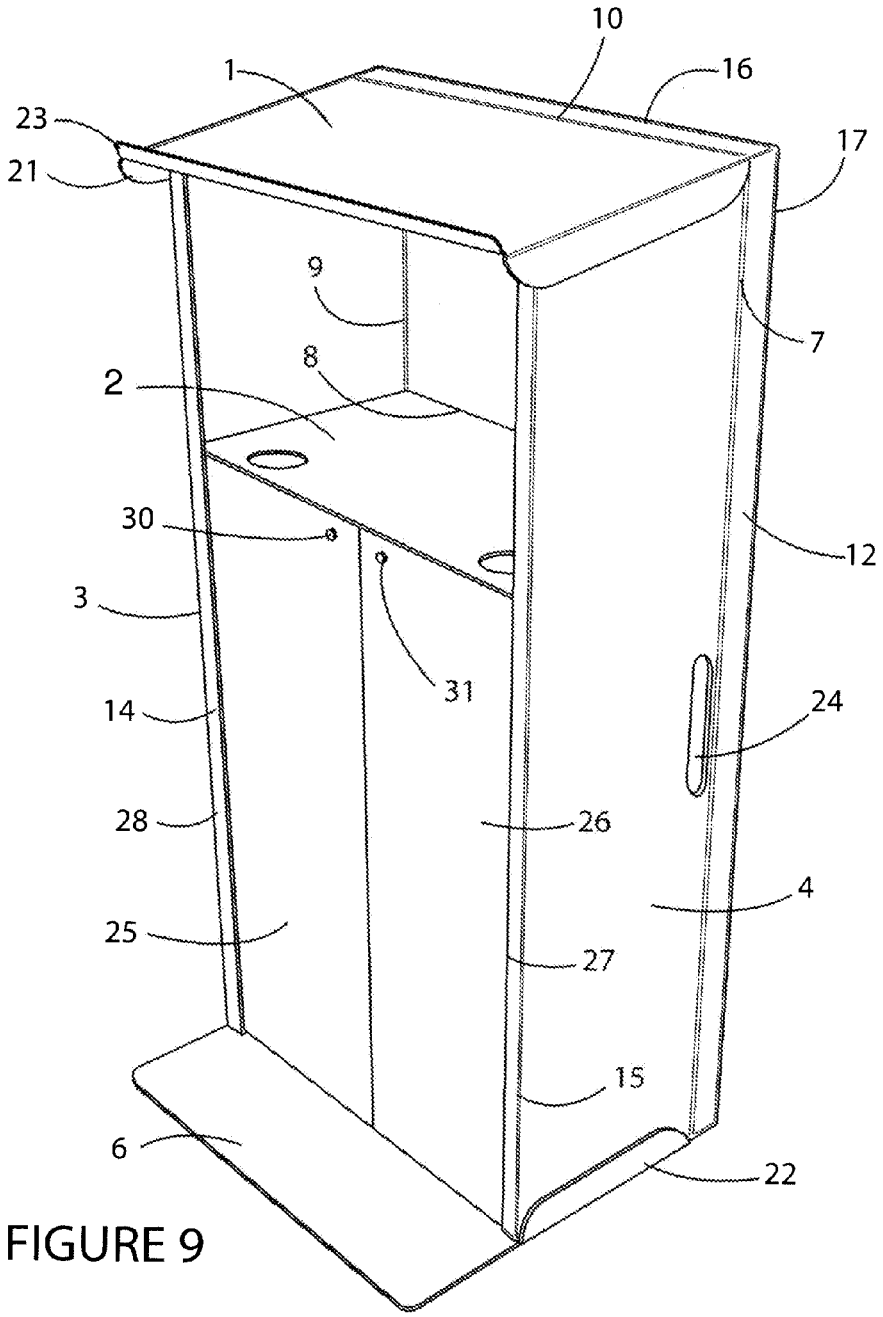
FIG. 9 shows a view of an alternative embodiment of the podium

FIG. 9 shows a view of an alternative embodiment of the podium from the side and behind the podium. At the top of the podium is a desk top 1 on which the speaker may place papers, display control devices, and the like. At the bottom of the podium is a base panel 6. In the middle of the podium is a middle shelf 2. The front panel 17 of the podium has side lips 12, and a top lip 16. The desk top 1 attaches to the top lip 16 of the front panel 17 of the podium with a hinge 10. The middle shelf attaches to the inside of the front panel 17 with a hinge 8. The left side panel of the podium (from the speaker's point of view) 3 is shown. The left side panel has a lip 14. The right side panel of the podium (from the speaker's point of view) 4 is shown. The right side panel has a lip 15. The side panels 3 and 4 are attached to the front panel 17 by hinges 9 and 7. Side lip 21 of the desk top 1 and side lip 22 of the base panel 6 are shown. An optional front lip 23 on the desk top 1 is shown. An optional slot 24 on the side panel 4 is shown. Optional supports 25 and 26 are shown. Support 25 is attached to side lip 14 of side panel 3 by hinge 28, and support 26 is attached to side lip 15 of side panel 4 by hinge 27. Fasteners 30 and 31 to hold the supports 25 and 26 to the middle shelf lip are shown. The lip 29 of middle shelf 2 is behind supports 25 and 26 and not seen in this view.

Figure 10:
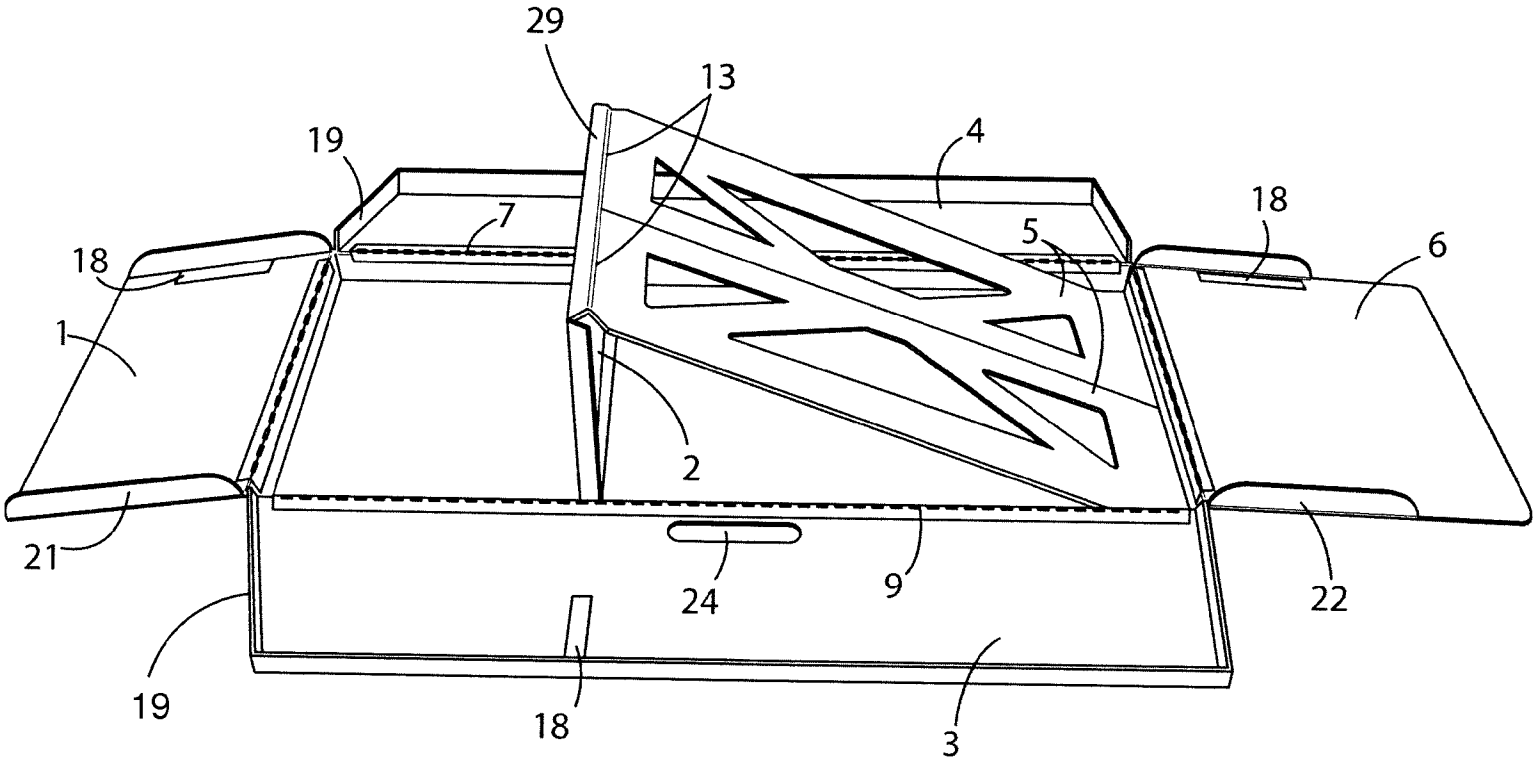
FIG. 10 shows an alternative embodiment of the invention.

FIG. 10 shows a view of another embodiment of the invention. The front panel 17 is down and not shown. The desk top 1, base panel 6, side panels 3 and 4, hinges 9 and 7, a fastening means 18, slanted tops 19 of the side panels 3 and 4, middle shelf 2, two supports 5, two hinges 13, side lip 21 of the desk top 1, and side lip 22 of the base panel 6 are shown.

Figure 11A:
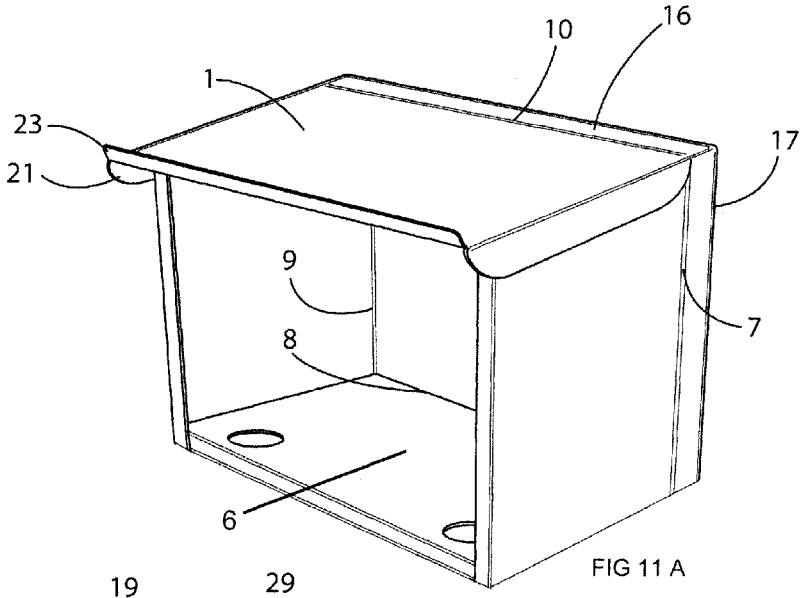
FIG. 11 A shows a view of a desk or table top embodiment of the invention in upright position.
Figure 11B:
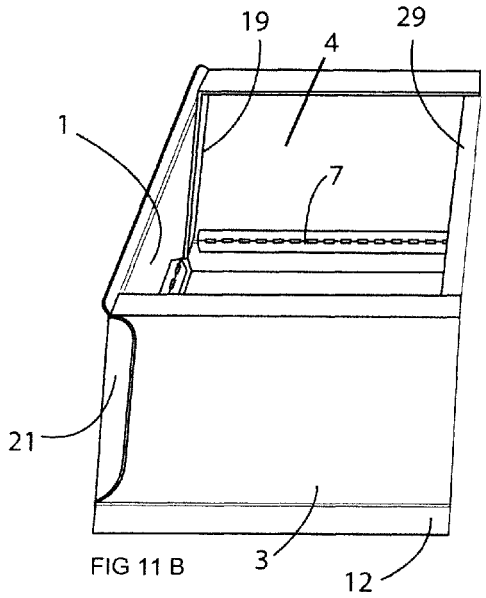
Figure 11C:
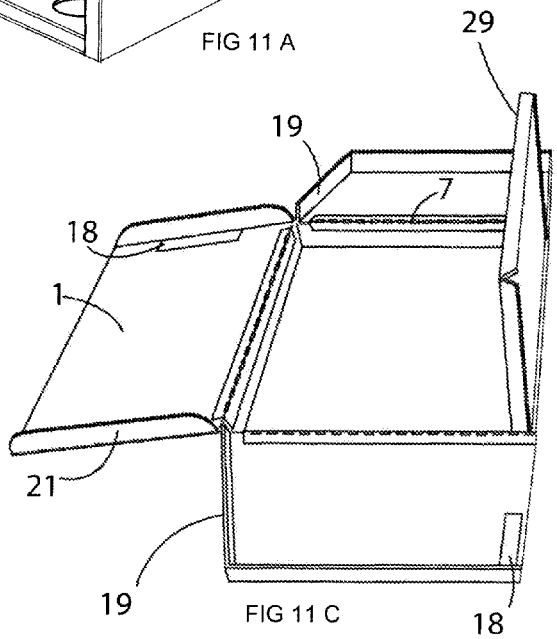

FIGS. 11 A, 11 B, and 11 C show a table top embodiment of the podium. The podium may also be placed on top of a desk, or other convenient surface. This table top embodiment is convenient in a situation where there is a table or desk already in a room. The table top embodiment can conveniently convert a table or desk into a podium. For example, an ordinary cafeteria table can be converted into a podium if there is a need to address a group gathered in a cafeteria. This can be useful because many businesses have cafeterias with tables, but do not have an auditorium. The table top podium differs from the full sized podium in that the table top unit lacks a shelf. However, because it is shorter, it does not require the bracing which a shelf provides in the full size unit. The table top podium folds into a single unit in the same manner as the full sized podium. When the table top podium is folded into a single unit, it is kept from unfolding by a fastening means such as Velcro® hook and loop fasteners.

FIG. 11 A shows a view of the unfolded table top podium from the side and behind the podium. At the top of the podium is a table top 1 on which the speaker may place papers, display control devices, and the like. At the bottom of the podium is a base panel 6 which rests on the table or table top when the podium is in use. The front panel 17 of the podium has a top lip 16. The table top 1 attaches to the top lip 16 of the front panel 17 of the podium with a hinge 10. The side panels, not numbered in this view, are attached to the front panel 17 by hinges 9 and 7. The bottom of the podium 6 attaches to the inside of the front panel 17 with a hinge 8. Side lip 21 of the table top 1 is shown. An optional front lip (side closest to the speaker) 23 on the desk top 1 is shown.

FIG. 11 B shows a view of the unfolded podium resting on its front panel. The top of the podium, the desk top 1 is on the left in this view. A lip 29 on the base of the podium is shown (right side). A side panel 3 is shown. Side panel, not numbered in this view, is attached to the front panel, not numbered in this view, by hinge 7. The front panel, not numbered in this view, has side lips 12. Optionally the tops 19 of the side panels 3 and (4, not numbered in this view) may be slanted allowing the desk top 1 to be slanted downward rather than being horizontal. Side lip 21 of the desk top 1 is shown.

FIG. 11 C shows a view of the podium resting on its front panel. The podium is being folded for storage. The top of the podium, the desk top 1 is on the left in this view. A lip 29 on the base of the podium is shown (right side). Side lip 21 of the desk top 1 is shown. Optionally the tops 19 of the side panels, not numbered in this view, may be slanted allowing the desk top 1 to be slanted downward rather than being horizontal. The side panels, not numbered in this view, are shown. Side panel (4, not numbered in this view) is attached to the front panel, not numbered in this view, by hinge 7. A fastening means 18 such as Velcro® hook and loop fastener is shown.

The podium may be made from a wide variety of materials including wood, wood products, plastics, and metals. The podium may be made from a variety of woods including the common woods such as pine, oak, maple and cherry or decorative woods such as walnut, hickory, teak and mahogany. Wood products suitable for the construction of the podium include plywood, chipboard and fiberboard. Plastics suitable for construction of the podium include polycarbonate, acrylic, Plexiglas® (a trademark of Rohm and Haas for a polymethylmethacrylate plastic), polyvinyl chloride (PVC), fiberglass, polystyrene, and extruded plastics. Suitable metals for construction of the podium include copper, titanium, steel, stainless steel, aluminum, and aluminum magnesium alloys. If the podium is made from wood or a wood product the lips may be prepared as separate pieces of wood, wood product, or metal which are fastened to the panels by a fastening means such as nails, screws or glue. If the podium is made from a plastic material, the lips would also be separate pieces of material which could be glued to the panels. If the front and side panels are made from an extruded plastic, the hinges may be extruded as an integral part of the panel. In this case the front panel and the side panel would each have half a hinge. The hinge halves are brought together and inserting a hinge pin completes the hinge. If the podium is made from metal, the metal panels may simply be stamped to achieve the desired shape.

It is possible to build the podium from a mixture of materials. One could, for example build a wooden front panel 17 and desk top 1 while making the middle shelf, the side panels and the base panel 6 out of metal. If the appearance of wooden front panel 17 is desired, it is possible to fashion metal "L" shaped piece, which could be attached to sides of the wooden front panel 17 servings as lips. The hinges could be attached to the metal lips and the rest of the podium could be made from metal. Colored plastics could be used to change the appearance of the podium. Aluminum is the preferred material for construction of the podium because it is light weight and strong. It is easy to coat or anodize aluminum to obtain a variety of appearances.

The podium may be decorated in a wide variety of ways. If the podium is made totally, or partially of wood, the wood portions may be stained and coated with a varnish such as polyurethane. The wood surface may be painted. If the podium is made from mild steel, the surfaces may be coated with clear lacquer or a wide variety of colored lacquers. Automotive finishes would be appropriate. In addition steel may be covered with wet coat paint. Stainless steel may be lacquered, painted, brushed, or polished. Aluminum may be anodized, painted, lacquered, brushed, or polished. Decorative labels or plaques may be applied to the surfaces of the podium. Laser designs can be cut in the surfaces. By these means the podium can personalized to reflect the taste of the user.

In a preferred embodiment the podium is constructed from several pieces of aluminum held together by hinges. The hinges may be welded, glued, or taped to the aluminum pieces. Welding methods such as metal inert gas welding, tungsten inert gas (TIG), and spot welding are suitable for attaching the hinges. The hinges may be screwed to the aluminum pieces. The hinges may be taped to the aluminum pieces using a tape suitable for metal attachment such as 3 M® VHB® acrylic foam tape. The hinges may also be glued to the aluminum pieces using epoxy or cyanoacrylate glues.

The hinges which connect the various components of the podium may be piano or continuous hinges, pivot hinges, spring hinges, door hinges, butt hinges, cabinet hinges, friction hinges, and strap hinges hinges. Piano hinges are preferred, but a piano hinge may be replaced by one or more pivot hinges, spring hinges, door hinges, butt hinges, cabinet hinges, friction hinges, and strap hinges. If a single pivot hinge, spring hinge, door hinge, butt hinge, cabinet hinge, friction hinge, or strap hinge is used instead of a piano hinge, it should be placed close to the center of the movable component of the podium. It is preferred to use two or more pivot hinges, spring hinges, door hinges, butt hinges, cabinet hinges, friction hinges, or strap hinges, or a single piano hinge for making a connection.

The portable podium has a front panel 17 to which are attached a desk top 1, a base panel 6, two side panels 3 and 4, and a middle shelf 2. Optionally, a support 5 may be attached to the middle shelf. The front panel 17 has a lip on all sides to which the desk top 1, base panel 6 and side panels are attached. Specifically, the desk top 1 is attached to the top lip 16. The base panel 6 is attached to the bottom lip 20. The side panels are attached to the side lips 12.

The lips on the front panel 17 serve two purposes. First they provide a point of attachment for the hinges which connect the desk top 1, base panel 6, and side panels 3 and 4 to the front panel 17. Each attachment can be made with a piano hinge or one or more pivot hinges, spring hinges, door hinges, butt hinges, cabinet hinges, friction hinges, or strap hinges. The second purpose of the lips on the front panel 17 is to create a space into which the parts of the podium may be folded when the podium is fully folded for storage or transportation.

The middle shelf 2 is attached to the inside of the front panel 17 with a hinge 8 at a proper height for a shelf. The middle shelf 2 has a lip 29 at the front closest to the speaker. The height of the shelf may vary depending upon the use to be made of the podium. Ordinarily the middle shelf 2 would be about 12 to 18 inches below the desk top 1. If it is envisioned that the podium will be used with bulky items to be stored on the shelf, the middle shelf 2 might be two feet below the desk top 1. The hinge 8 allows the middle shelf 2 to fold flat against the back of the front panel 17 when the podium is folded for storage or transportation. If the podium is equipped with an optional support 5 for the middle shelf 2, a hinge 13 allows the support 5 to fold back to cover the middle shelf 2. The side panels 3 and 4 of the podium fold toward the center to cover the middle shelf 2, and the optional support 5. The desk top 1 has two side lips 21, and the base panel 6 has two side lips 22. The desk top 1 and the base panel 6 are wider than the front panel 17 so that the side lips 21 and 22 cover the side lips 12 of the front panel 17. When the podium is folded, as described above, it becomes a rectangular object which may be readily stored or transported to another location. Optionally, a fastening means 18 such as a Velcro® hook and loop fastener may be provided to fasten the desk top 1 and the base panel 6 to the side panels 3 and 4 when the podium is folded. Other fasteners such as magnets clips, fastener snaps, spring pins, and twist-locks could be used. This fastening means prevents the podium from unfolding during transportation. Hinges 8 and 13 can be single piano hinges, or one or more pivot hinges, spring hinges, door hinges, butt hinges, cabinet hinges, friction hinges, and strap hinges.

When the podium is to be used, the unit is simply unfolded. The desk top 1 and the base panel 6 are opened. The side panels 3 and 4 are unfolded and the middle shelf 2 is moved into position. The side panels 3 and 4 are brought into position, and the desk top 1 and base panel 6 are put into position. Because the desk top 1 and base panel 6 are wider than the front panel 17, the side lips 21 and 22 of the desk top 1 and base panel 6 cover the side panels 3 and 4. The side panels 3 and 4 are held rigidly because they are prevented from moving inward by the middle shelf 2 and are prevented from moving outward by the side lips 21 and 22 of the desk top 1.

If an optional support is present the top of the support is 5 attached to the lip 29 of the middle shelf 2 by a hinge 13. When the podium is unfolded for use, the support is placed so that so that bottom part of the rests on the bottom lip of the front panel 17. Although the podium does not require a support, the support does add extra stiffness to the podium. The support may be made of any material from the podium may be constructed. Aluminum is a preferred material. The support may be constructed from a solid piece of metal. However, this increases the weight of the support. It is possible to have a support in the form of a metal sheet with cut outs. This lowers the weight of the support without appreciably reducing its strength. Another embodiment which can reduce the weight of the support assembly is shown in FIG. 10. In this embodiment there are two smaller supports 5 instead of one single support. Each support is attached to the lip 29 of the middle shelf 2 by one or more hinges 13. The individual supports may be narrower than half the size of a full single support. Thus, the two supports could weigh less than a full size single solid support without cutouts. These two supports could either be solid or have cutouts. Hinge 13 can be single piano hinge, or one or more pivot hinges, spring hinges, door hinges, butt hinges, cabinet hinges, friction hinges, or strap hinges. Since each support is independently hinged, there are two or more hinges for the supports Optionally the side panels may have a slanted top 19. This allows the desk top 1 to slant downward rather than being horizontal. Most podiums have a downward slope on the desk top 1, and this is a preferred embodiment for the present invention. If the side panels are sloped, and the desk top 1 slants downward, it is convenient for the desk top 1 to have an optional front lip 23. This keeps papers from sliding off the downward slanted podium desk top 1.

Optionally, slots 24 may be cut in the side panels 3 and 4. These slots can serve as handles for carrying the folded podium. The slots should have a size such that a person can conveniently place their hand in the slot. Although the placement of the slots is not critical, it is preferred that the slots be close to a balancing point so that when a person is carrying the folded podium using the slots as handles, the podium is neither front heavy nor rear heavy.

An alternative embodiment of the podium is shown if FIG. 9. In this embodiment, there are two supports 25 and 26 which are attached to the lips 14 and 15 of the side panels 3 and 4 by hinges 27 and 28. Hinges 27 and 28 can be single piano hinges, or one or more pivot hinges, spring hinges, door hinges, butt hinges, cabinet hinges, friction hinges, or strap hinges.

When the podium is folded, the supports 25 and 26 fold inside the side panels 3 and 4. When the podium is unfolded for use, the supports fold out and are secured to the front lip of the middle shelf. The supports 25 and 26 are secured to the lip of the middle shelf 29 by a fastening means such as magnetic cabinet latches, or captive fasteners. This fastening means is not a hinge but is instead a fully openable fastener. Thus, when the podium is to be folded, the two supports 25 and 26 remain attached to the lips 14 and 15 of the side panels 3 and 4 by two or more hinges 27 and 28. The fully openable fastener attaching the supports 25 and 26 to the lip 29 of the middle shelf 2 is opened and the supports 25 and 26 are no longer attached to the lip 29 of the middle shelf 2. Captive fasteners are a preferred openable fastener for attaching the supports to the lip 29 of the middle shelf 2 of the podium. Captive fasteners have a screw attached to the supports 25 and 29 and a captive nut attached to the middle shelf lip 29. The screw is part of an assembly which is pressed into a hole in a sheet metal panel, in this case, the supports 27 and 28. The assembly is held firmly in the panel, and the screw can be turned to engage the nut. The screw portion of the captive fastener has a ferrule at the end so that the screw may be easily turned by hand. The nut is similarly part of an assembly pressed into a hole in the lip of the middle shelf 29. The nut is positioned so that it can engage the threads of the captive fastener screw. Captive fasteners can be closed or opened quickly without tools. In this embodiment, the supports 27 and 28 create a cabinet under the middle shelf 2 of the podium. The ferrule of the captive fastener acts as a cabinet door handle. The cabinet under the middle shelf may be used to store objects which may be needed while the podium is being used. For example, if a speaker had a box of brochures to be handed out after the speech, the box could be stored in the cabinet under the center shelf, rather than being placed next to the podium.

EXAMPLE I

A podium was constructed from 0.06 inch thick aluminum metal sheets. The metal was cut and stamped to form a front panel, a desk top, two side panels, a middle shelf, a support, and a base panel. The desk top, side panels, middle shelf, and base panel were attached to the front panel by hinges. A brace 5, as shown in FIG. 1, was made from a metal sheet with cutouts to reduce weight. It was attached to the middle shelf by a hinge. All hinges were attached using 3 M® VHB® acrylic foam tape. The podium had slanting side panels and the desk top slanting downward. The desk top had a front lip to prevent papers from sliding off the desk top. Holes approximately 4.5 inches long and 1.25 inches wide, serving as handles, were cut in the side panels. When folded the podium was 42 inches long, 20 inches across, and 2 inches thick including the front lip on the podium desk top. When unfolded for use the front panel was 42 inches long, the podium was 12 inches deep and the desk top measured 20⅜ inches across by 12 inches deep. The complete podium weighed 17.5 pounds.

The invention claimed is:

1. A foldable single unit table top portable podium constructed from materials selected from the group consisting of wood, wood products, plastics, and metals comprising (a) a front panel having a top lip, a bottom lip, and two side lips, (b) a desk top, having two side lips, connected to the top lip of the front panel by one or more hinges selected from the group consisting of piano hinges, pivot hinges, spring hinges, door hinges, butt hinges, cabinet hinges, friction hinges, and strap hinges, (c) a left side panel connected to a left side lip of the front panel by one or more hinges selected from the group consisting of piano hinges, pivot hinges, spring hinges, door hinges, butt hinges, cabinet hinges, friction hinges, and strap hinges, (d) a right side panel connected to a right side lip of the front panel of the front panel by one or more hinges selected from the group consisting of piano hinges, pivot hinges, spring hinges, door hinges, butt hinges, cabinet hinges, friction hinges, and strap hinges, and (e) a base panel, having two side lips, connected to bottom lip by one or more hinges selected from the group consisting of piano hinges, pivot hinges, spring hinges, door hinges, butt hinges, cabinet hinges, friction hinges, and strap hinges, wherein the top lip provides a point of attachment for the desk top, the bottom lip provides a point of attachment for the base panel, the left side lip of the front panel provides a point of attachment for the left side panel, and the right side lip of the front panel provides a point of attachment for the right side panel, wherein the top lip, the two side lips, and the bottom lip create a space into which the left side panel, and the right side panel of the podium may be folded, and wherein the podium is constructed from materials selected from the group consisting of wood, wood products, plastics, and metals.

2. A foldable single unit table top portable podium according to claim 1 constructed from aluminum.

3. A foldable single unit table top portable podium according to claim 1 in which the desk top is connected to the top lip of the front panel by one or more piano hinges.

4. A foldable single unit table top portable podium according to claim 1 in which the left side panel is connected to a left side lip of the front panel by one or more piano hinges.

5. A foldable single unit table top portable podium according to claim 1 in which the right side panel is connected to a right side lip of the front panel by one or more piano hinges.

6. A foldable single unit table top portable podium according to claim 1 in which the base panel is connected to bottom lip by one or more piano hinges.

* * * * *